US006437775B1

(12) United States Patent
Hanari

(10) Patent No.: US 6,437,775 B1
(45) **Date of Patent: *Aug. 20, 2002**

(54) FLAT DISPLAY UNIT

(75) Inventor: Jun Hanari, Yokohama (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,142

(22) Filed: Sep. 9, 1999

(30) Foreign Application Priority Data

Sep. 21, 1998 (JP) ..... 10-266903

(51) Int. Cl.[7] ..... G09G 5/00

(52) U.S. Cl. ..... 345/204; 345/96; 345/208; 345/98; 345/559

(58) Field of Search ..... 345/204, 87–89, 345/92, 94, 96, 98–100, 55, 209, 206, 559, 104, 58, 213; 377/69; 327/144

(56) References Cited

U.S. PATENT DOCUMENTS 5,708,455 A * 1/1998 Maekawa ..... 345/100
5,894,296 A * 4/1999 Maekawa ..... 345/98
6,020,871 A * 2/2000 Asada ..... 345/98
6,049,321 A * 4/2000 Sasaki ..... 345/99
6,157,228 A * 12/2000 Yokoyama et al. ..... 327/144
6,184,855 B1 * 2/2001 Kobayashi et al. ..... 345/100
6,232,939 B1 * 5/2001 Saito et al. ..... 345/93

FOREIGN PATENT DOCUMENTS

JP 8-30242 2/1996

* cited by examiner

*Primary Examiner*—Richard Hjerpe
*Assistant Examiner*—Francis Nguyen
(74) *Attorney, Agent, or Firm*—Oblon, Spivak, McClelland, Maier & Neustadt, P.C.

(57) ABSTRACT

A flat display unit has a display area including scanning lines, signal lines, switching elements arranged in the vicinity of intersections of the scanning lines and the signal lines, and display pixels connected to corresponding switching elements. The display area is divided into small regions, each of which includes a set of signal lines and signal line driving circuits, each of which is arranged to correspond to one of the small regions, for supplying a picture signal to each set of signal lines in parallel. At least one of the signal line driving circuits has a shift register for transferring a start pulse in a predetermined direction in a predetermined timing, a sampling circuit for sampling an input picture signal to supply the picture signal to a corresponding one of the signal lines on the basis of an output of each stage of the shift register, and a control circuit for inverting the transfer direction of the start pulse.

13 Claims, 5 Drawing Sheets

FLAT DISPLAY UNIT

BACKGROUND OF THE INVENTION

1. Field of the invention

Relates generally to a flat display unit.

2. Description of the Prior Art

Conventionally, amorphous silicon thin film transistors (TFTs) have been used for the display part of an active matrix liquid crystal display unit. However, in recent years, polysilicon TFTs have been often used.

The polysilicon TFT has a higher mobility than that of the amorphous silicon TFT. For that reason, the driving part of the liquid crystal display unit comprises polysilicon TFTs. Therefore, when the display part comprises polysilicon TFTs, a part of the driving circuit (the peripheral driving circuit) of the liquid crystal display unit can be formed on the same substrate as that of the display part.

By the way, the display part of a liquid crystal display unit using polysilicon TFTs substantially has the same construction as that of the display part of a liquid crystal display unit using amorphous silicon TFTs. That is, although data are written on pixel by pixel driving TFTs, the holding characteristic based on only the electrostatic capacitance of the liquid crystal layer is insufficient, so that an auxiliary capacitor is typically connected.

This auxiliary capacitor is arranged for each of the pixels. One electrode of the auxiliary capacitor is connected to a corresponding one of the TFTs, and a potential for forming each capacitor is applied to the other electrode of the auxiliary capacitor. Lines for supplying this potential are arranged in the display part so as to extend typically in parallel to the gate signal lines of the pixel driving TFTS. The line for supplying the potential to the auxiliary capacitor will be hereinafter referred to as an auxiliary capacitance line.

As described above, in the liquid crystal display unit using the polysilicon TFTs, a part of the driving circuit (the peripheral driving circuit) may be formed on a glass substrate. As such a peripheral driving circuit, there is considered a construction wherein analog switches 10*a*, 10*b* combined with a shift register (not shown) are formed on a glass substrate as shown in FIG. 4.

In this case, as a external driving circuit, an exterior printed-circuit board may be provided with a digital-analog converting part and an output buffer for transmitting data to pixels/signal lines.

In this case, a method for simultaneously transmitting data to some signal lines may be adopted in order to decrease the number of data signal lines. That is, there may be adopted a method for diving pixels to be driven during one horizontal period and for driving each block of some pixels. Moreover, if a block sequential driving method for sequentially driving blocks is adopted, it is possible to further decrease the number of the data signal lines.

For example, a method for driving a screen having an array of 1024 dots in a horizontal direction will be described. That is, the case of XGA of 1024×768 will be described. Furthermore, one dot comprises three pixels of R, G and B.

Assuming that one block has 24 pixels (i.e., 8 dots) connected to 24 signal lines, if each block is sequentially driven during 1/32 of one horizontal period, 256 dots can be driven during one horizontal period. This corresponds to 1/4 of the screen, so that data signals may be inputted to the screen in four-parallel.

This block sequential driving system has the merits of being capable of decreasing the number of the data signal lines and decreasing the frequency for data transfer. However, this system has the following problems.

That is, when data are written on a certain signal line 24 as shown in FIG. 4, the fluctuation in potential of the signal line 24 is transmitted to another signal line 24 via a parasitic capacitor 40 which is produced in a portion wherein the signal line 24 crosses the above described auxiliary capacitance line 30, so that the fluctuation appears on the screen as noise.

In order to explain this phenomenon, adjacent pixels on a certain auxiliary capacitance line are considered in the case of the block sequential driving system for transferring data every last block.

The fluctuations of the potentials of the auxiliary capacitance lines in one block due to an optional data signal do not often have regularity, so that the fluctuations are canceled out to have a small influence on other signal lines.

However, in a case where data on white and black are alternately repeated every one block, the data lines are simultaneously distorted in the same direction, so that the fluctuations of the potentials of the auxiliary capacitance lines are great (see FIG. 5). Since the potentials of the auxiliary capacitance lines are typically supplied from a power supply provided outside, the ability to suppress the fluctuations in the screen is low, so that the last fluctuation is not canceled during a write time for one block. For that reason, when data are written on the next block, the potential of the auxiliary capacitance line is different from that when data are written on the last block. Therefore, the potential applied to the liquid crystal varies, so that an image shifted from a predetermined gradation is recognized to cause noise. When the potential of the auxiliary capacitance line further fluctuates due to signals in the written block, the change in potential of the auxiliary capacitance line is stored, so that the influence increases when data are written on the next block (see FIG. 6).

SUMMARY OF THE INVENTION

It is therefore an object of the present invention to eliminate the aforementioned problems and to provide a flat display unit capable of obtaining a good display screen.

In order to accomplish the aforementioned and other objects, according to a first aspect of the present invention, a flat display unit comprises: a display area including a plurality of scanning lines, a plurality of signal lines, a plurality of switching elements, each of which is arranged in the vicinity of each of the intersections of the scanning lines and the signal lines, and a plurality of display pixels, each of which is connected to a corresponding one of the switching elements, the display area being divided into a plurality of small regions, each of which includes a set of signal lines of the plurality of signal lines; and a plurality of signal line driving circuits, each of which is arranged so as to correspond to a corresponding one of the small regions, for supplying a picture signal to each set of signal lines in parallel, at least one of the plurality of signal line driving circuits comprising: a shift register for transferring a start pulse in a predetermined direction in a predetermined timing; a sampling circuit for sampling an input picture signal to supply the picture signal to a corresponding one of the signal lines on the basis of an output of each stage of the shift register; and a control circuit for inverting the transfer direction of the start pulse every a predetermined time.

The transfer direction of the start pulse in one of adjacent two of the plurality of small regions may be the reverse of that in the other small region during the same period.

The predetermined period may be one horizontal scanning period in which a selecting voltage is applied to one of the plurality of scanning lines.

The sampling circuit may be integrally formed on a substrate constituting the flat display unit.

According to a second aspect of the present invention, a flat display unit comprises: a display area including a plurality of scanning lines, a plurality of signal lines, a plurality of switching elements, each of which is arranged in the vicinity of each of the intersections of the scanning lines and the signal lines, and a plurality of display pixels, each of which is connected to a corresponding one of the switching elements; a shift register for transferring a start pulse in a predetermined direction in a predetermined timing; a sampling circuit for simultaneously sampling a plurality of input picture signals to simultaneously supply the picture signals to a corresponding some of the plurality of signal lines on the basis of an output of each stage of the shift register; and a control circuit for inverting the transfer direction of the start pulse every a predetermined time.

The polarities of the picture signals supplied to adjacent signal lines of the plurality of signal lines may be inverted from each other.

The predetermined period may be one horizontal scanning period in which a selecting voltage is applied to one of the plurality of scanning lines.

The sampling circuit may be integrally formed on a substrate constituting the flat display unit.

According to a third aspect of the present invention, a flat display unit comprises: a display area including a plurality of scanning lines, a plurality of signal lines, a plurality of switching elements, each of which is arranged in the vicinity of each of the intersections of the scanning lines and the signal lines, and a plurality of display pixels, each of which is connected to a corresponding one of the switching elements, the display area being divided into a plurality of small regions, each of which includes a set of signal lines of the plurality of signal lines; and a plurality of signal line driving circuits, each of which arranged so as to correspond to a corresponding one of the small regions, for supplying a picture signal to each set of signal lines in parallel, at least one of the plurality of signal line driving circuits comprising: a shift register for transferring a start pulse in a predetermined direction in a predetermined timing; a sampling circuit for simultaneously sampling a plurality of input picture signals to simultaneously supply the picture signals to a corresponding some of the set of signal lines on the basis of an output of each stage of the shift register; and a control circuit for inverting the transfer direction of the start pulse every a predetermined time.

The transfer direction of the start pulse in one of adjacent two of the plurality of small regions may be the reverse of that in the other small region during the same period.

The polarities of the picture signals supplied to adjacent signal lines of the plurality of signal lines may be inverted from each other.

The predetermined period may be one horizontal scanning period in which a selecting voltage is applied to one of the plurality of scanning lines.

The sampling circuit may be integrally formed on a substrate constituting the flat display unit.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, particularly to FIG. 1, a preferred embodiment of a liquid crystal display unit serving as a flat display unit according to the present invention will be described below. In this preferred embodiment, the liquid crystal display unit is an active matrix liquid crystal display unit driven by the block sequential driving method, and has a liquid crystal layer held between a matrix array substrate and a counter substrate via an alignment layer of, e.g., a polyimide.

Figure 1:
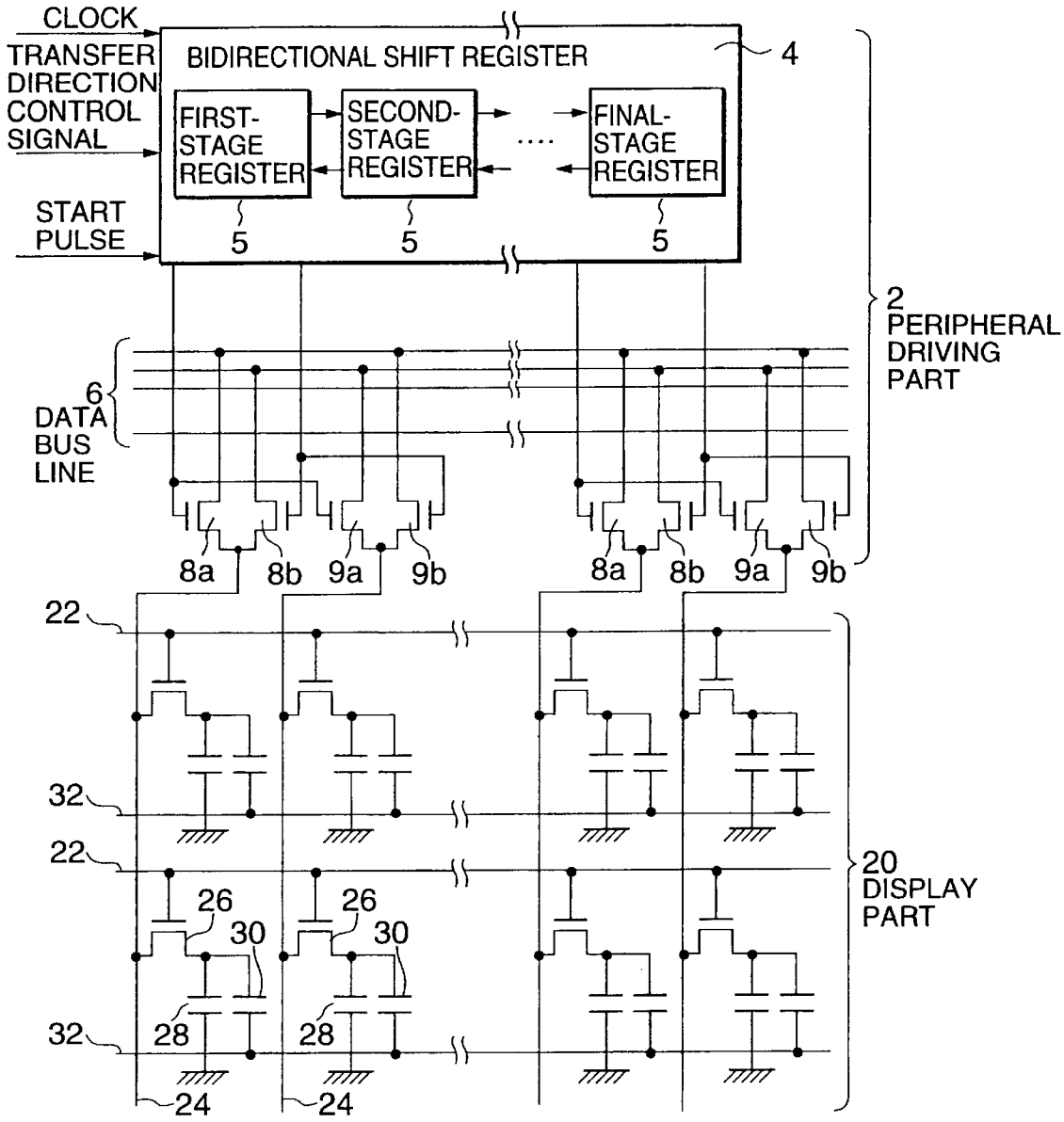
FIG. 1 is a block diagram of a preferred embodiment of a flat display unit according to the present invention.

As shown in FIG. 1, the matrix array substrate has a peripheral driving part 2 and a display part (a display area) 20, which are formed on a transparent substrate, e.g., a glass substrate. The counter substrate (not shown) has a counter electrode formed on a transparent substrate, e.g., a glass substrate.

The display part 20 comprise: a plurality of scanning lines 22 extending substantially in parallel; a plurality of signal lines 24 extending in a direction substantially perpendicular to the scanning lines 22; sets of switching elements (e.g., TFTs) 26, pixel electrodes 28 and auxiliary capacitors 30, each set being provided at each of the intersections of the scanning lines 22 and the signal lines 24; and auxiliary capacitance lines 32 extending substantially in parallel to the scanning lines 22.

One terminal of the source and drain of each of the TFTs 26 is connected to a corresponding one of the signal lines 24, and the other terminal is connected to one terminal of a corresponding one of the pixel electrodes 28 and one terminal of a corresponding one of the auxiliary capacitors 30. The gate of each of the TFTs 26 is connected to a corresponding one of the scanning lines 22. The other terminal of each of the auxiliary capacitors 30 is connected to a corresponding one of the auxiliary capacitance lines 32. A potential is supplied to each of the auxiliary capacitor 30 from the outside via the corresponding one of the auxiliary capacitance lines 32.

The peripheral part 2 comprises a bidirectional shift register 4 having plural stages of register parts 5 connected in series, data bus lines 6, and analog switches 8*a*, 8*b*, 9*a* and 9*b* provided for each stage of register parts 5.

Each of register parts 5 of the bidirectional shift register 4 is designed to transmit a start pulse (a shift pulse) to the next stage of register part 5 in response to a clock signal. The transfer direction of the start pulse is controlled by an external transfer-direction control signal supplied from the outside.

Figure 2:
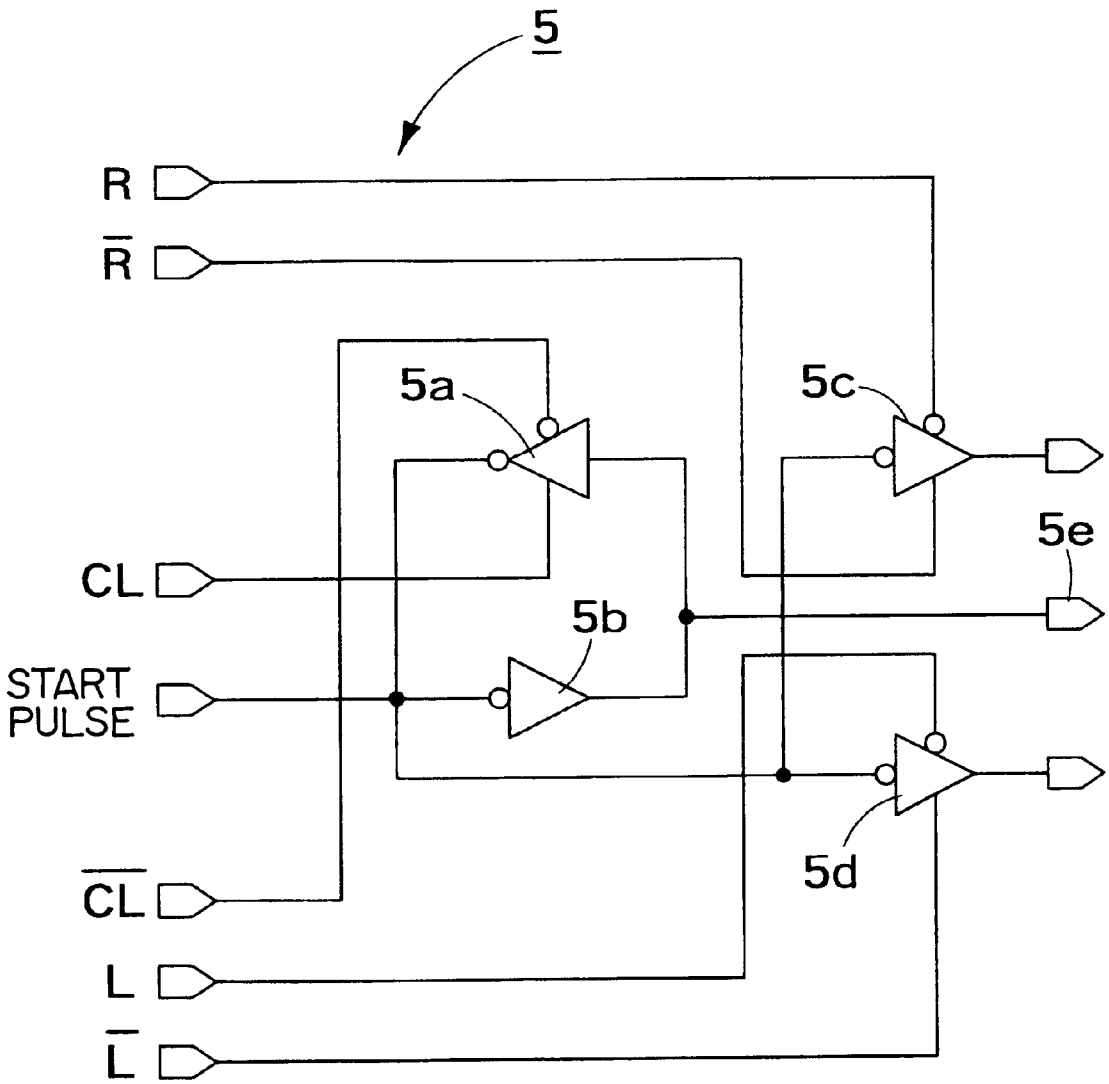
FIG. 2 is a circuit diagram of an example of a register part constituting a bidirectional register.

An example of one of the register parts 5 is shown in FIG. 2. In FIG. 2, the register part 5 has a flip-flop comprising a clocked inverter 5*a* and an inverter 5*b*, and clocked inverters 5*c*, 5*d*. The clocked inverter 5*a* operates in response to a clock signal CL and an inverted signal/CL thereof. The clocked inverter 5*c* operates in response to control signals R,/R for transferring the start pulse in the right direction, and delays the signal (the start pulse), which has been latched by the flip-flop circuit, by one clock to transfer the delayed signal to the next stage of register part 5 in the right direction. The clocked inverter 5*d* operates in response to control signals L,/L for transferring the start pulse in the left direction, and delays the signal (the start pulse), which has been latched by the flip-flop circuit, by one clock to transfer the delayed signal to the next stage of register part 5 in the left direction.

Figure 3:
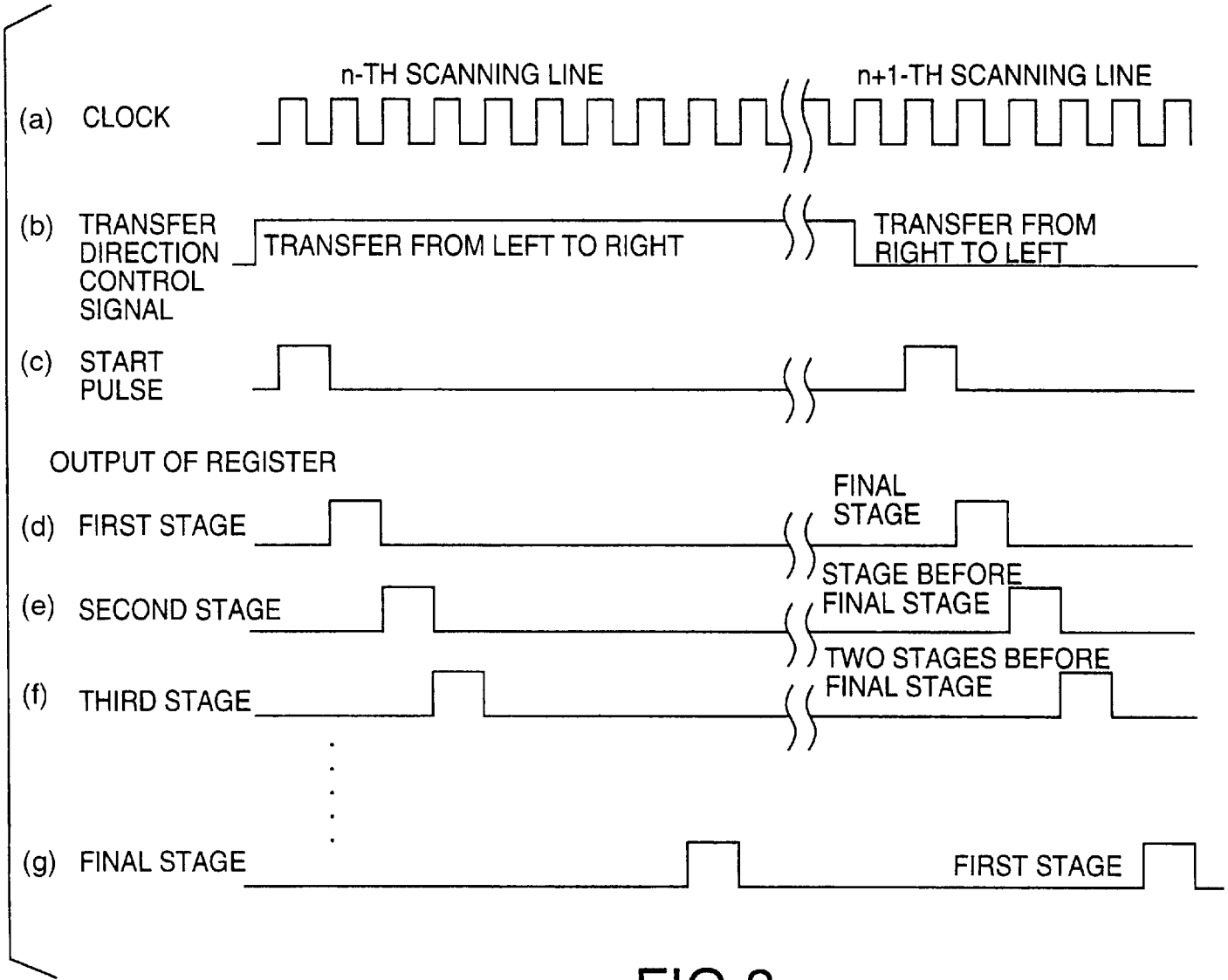
FIG. 3 is a timing chart showing the operation of a flat display unit according to the present invention.
Figure 4:
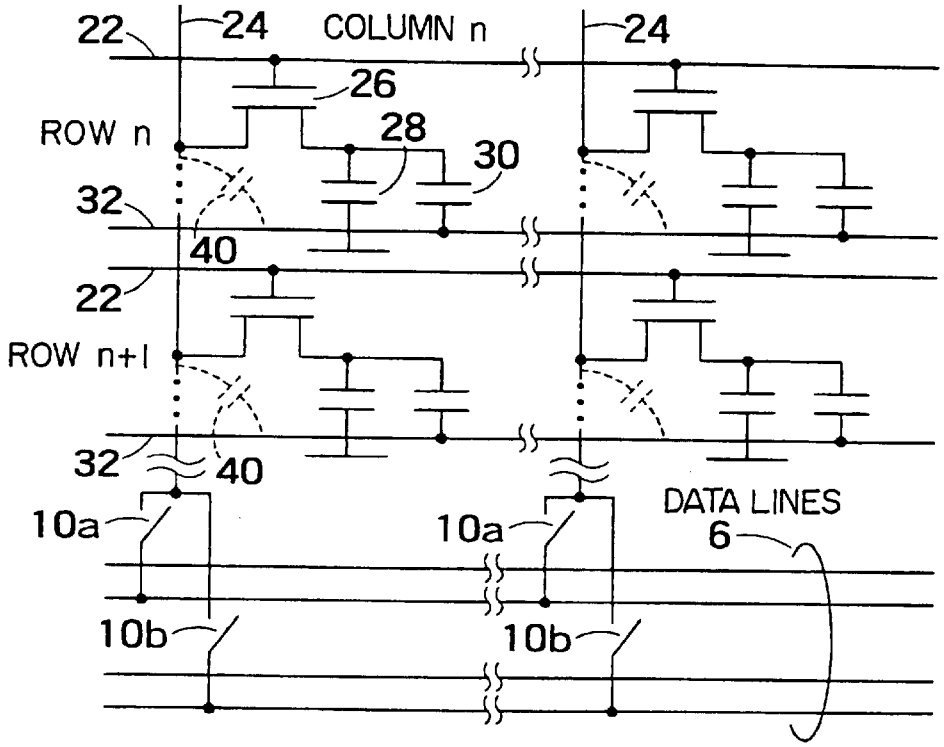
FIG. 4 PRIOR ART
FIG. 4 is a circuit diagram of an example of a conventional liquid crystal display unit of a block sequential driving system.
Figure 5:
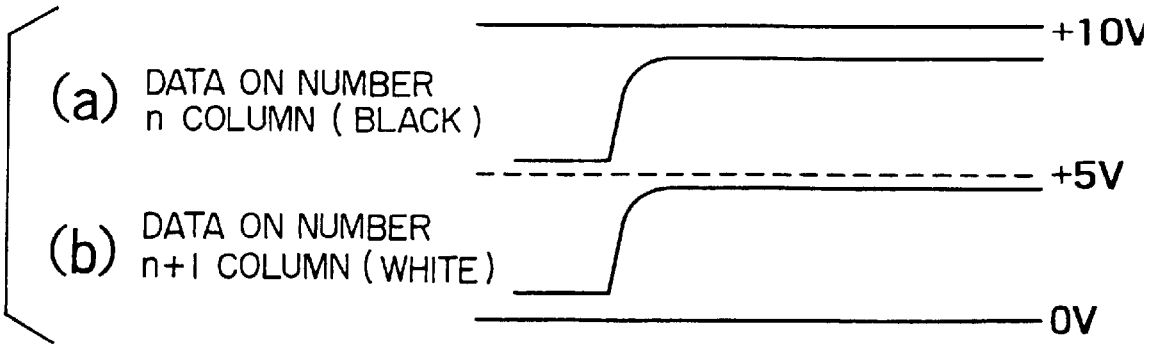
FIG. 5 PRIOR ART
FIG. 5 is a diagram for explaining the problems of a conventional liquid crystal display unit.
Figure 6:
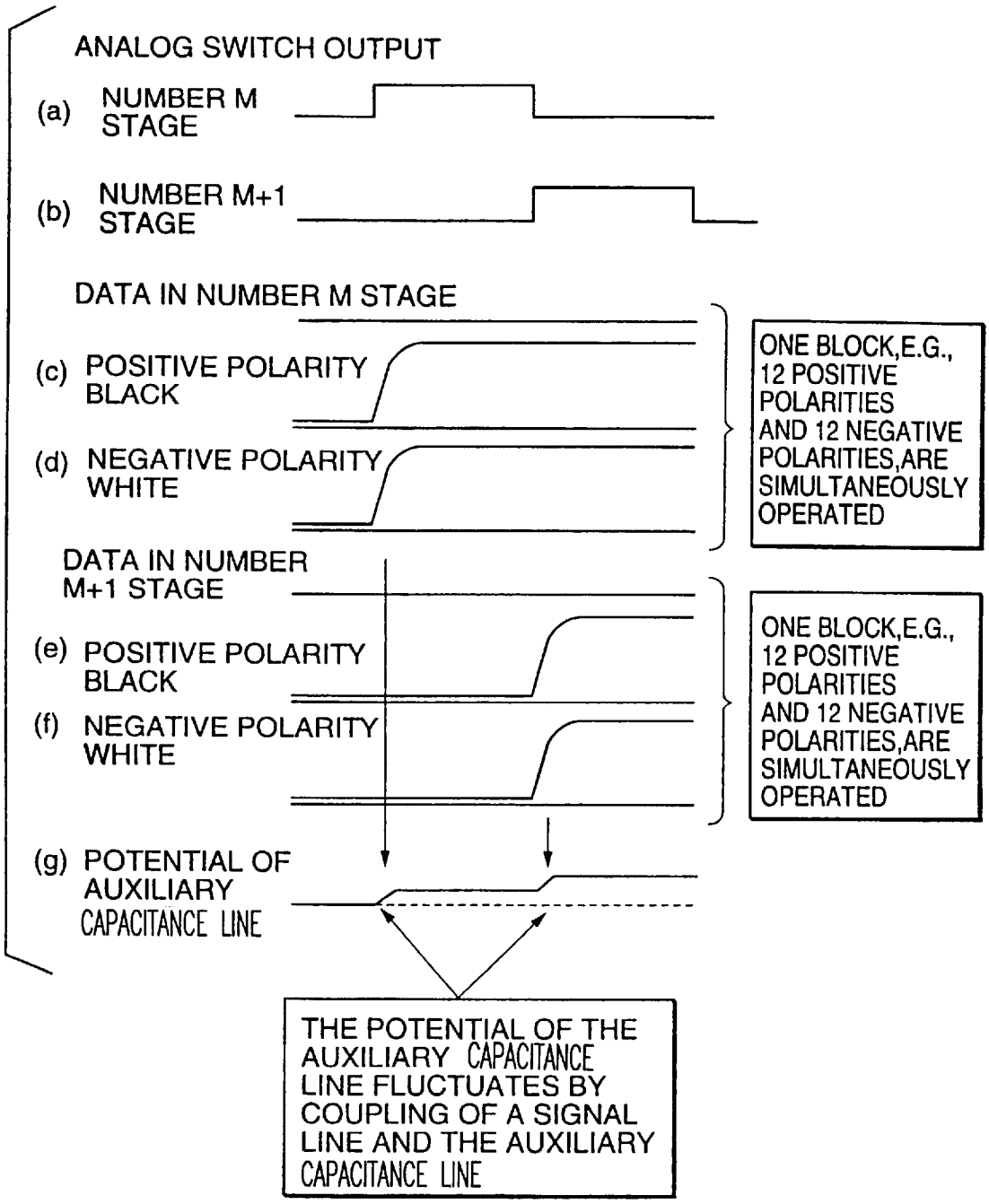
FIG.6 PRIOR ART
FIG. 6 is a diagram for explaining the problems of a conventional liquid crystal display unit.

Therefore, the start pulse is sequentially transferred in the right or left direction by the bidirectional register 4 as shown in FIG. 3.

In addition, the register part 5 latches the start pulse, which has been transmitted from the last stage, in synchronism with the clock signals CL,/CL to transmit the latched signal to the gate of a corresponding one of the analog switches 8*a*, 8*b*, 9*a* and 9*c* via an output terminal 5*e*.

The conductive types of the analog switches 8*a*, 9*a* are different from those of the analog switches 8*b*, 9*b*. For example, if the analog switches 8*a*, 9*a* are P-channel transistors, the analog switches 8*b*, 9*b* are N-channel transistors.

One end of each of the pair of analog switches 8*a*, 8*b* of each of the register parts 5 is connected to a corresponding one of odd number signal lines 24 from the left end of the screen, and one end of each of the other pair of analog switches 9*a*, 9*b* of each of the register parts 5 is connected to a corresponding one of even number signal lines 24 from the left end of the screen. In addition, the other end of each of the analog switches 8*a*, 8*b* is connected to a different one of the data bus lines 6, and the other end of each of the analog switches 9*a*, 9*b* is connected to a different one of the data bus lines 6.

The analog switches 8*a*, 9*a* connected to the same register part 5 are simultaneously turned ON to acquire picture signal data from different data bus lines 6 to write the picture signal data on the odd number and even number signal lines 24, respectively. The analog switches 8*b*, 9*b* connected to the same register part 5 perform the same operation. When each of the resister parts 5 latches the start pulse, one set of analog switches of the analog switches 8*a*, 9*a* and analog switches 8*b* and 9*b* of the corresponding one of the register parts 5, e.g., the analog switches 8*a*, 9*a*, are turned ON, and the other set of analog switches 8*b*, 9*b* are turned OFF. The set of analog switches turned ON varies in accordance with the polarity of the screen (frame).

In this preferred embodiment, the liquid crystal display unit uses the bidirectional shift register, so that the order in which the outputs of the register parts 5 appear on a number n (≧1) scanning line 22 from the top is the reverse of the order in which the outputs of the register parts 5 appear on a number n+1 scanning line 22 from the top as shown in FIG. 3. That is, the outputs of the first stage, the second stage, . . . , the final stage of register parts appear on the number n scanning line in that order, whereas the outputs of the final stage, the stage before the final stage, . . . , the final stage of register parts appear on the number n+1 scanning line in that order.

Therefore, the order in which the picture signal data are written on the signal lines 24 when the number n scanning line is selected is the reverse of the order in which the picture signal data are written on the signal lines 24 when the number n+1 scanning line is selected. That is, when the number n scanning line 22 is selected, the picture signal data are sequentially written on the signal lines 24 from the left to the right, whereas when the number n+1 scanning line 22 is selected, the picture signal data are sequentially written on the signal lines 24 from the right to the left.

Furthermore, between a case where the number n scanning line 22 is selected and a case where the number n+1 scanning line 22 is selected, it is required to reverse the order in which the picture signal data are transmitted to the liquid crystal unit in this preferred embodiment by the external driving circuit.

In the liquid crystal unit of this preferred embodiment, when white and black data are displayed every signal line, or when the voltage changing directions on the signal lines are the same in similar patterns, the fluctuations in voltage of the auxiliary capacitance lines have the same polarity every write, so that the potentials of the auxiliary capacitance lines increase in accordance with, e.g., write. As a result, the voltage applied to the liquid crystal is higher than a normal voltage, so that contrast increases.

That is, the potential of the auxiliary capacitance line increases from the left to the right on the number n scanning line, so that contrast increases, and the potential of the auxiliary capacitance line increases from the right to the left on the number n+1 scanning line.

As a result, the potential gradients of the auxiliary capacitance lines are different on every other line to be canceled out on the whole screen, so that the gradients are inconspicuous.

Thus, it is possible to remove a display defect in a specific pattern, so that it is possible to a good display unit.

While the bidirectional shift pulse has been used for switching the transfer direction of the shift pulse (the start pulse) in this preferred embodiment, the present invention should not be limited thereto.

In addition, while the transfer direction of the shift pulse has been switched every one horizontal period in this preferred embodiment, the transfer direction of the shift register may be switched every optional horizontal period to obtain the same advantage.

Furthermore, while each of the registers 5 of the bidirectional shift register 4 has driven two signal lines 24 in this preferred embodiment, it may drive three or more signal lines.

As described above, according to the present invention, even if the fluctuations of the potentials of the auxiliary capacitance lines are caused by write on the signal lines to have an influence on write on other portions, it is possible to cancel out the fluctuations, so that it is possible to obtain a good screen.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A flat display unit comprising:

a display area including a plurality of scanning lines, a plurality of signal lines, a plurality of switching elements, each of which is arranged in the vicinity of each of the intersections of said scanning lines and said signal lines, and a plurality of display pixels, each of which is connected to a corresponding one of said switching elements, said display area being divided into a plurality of small regions, each of which includes a set of signal lines of said plurality of signal lines; and a plurality of signal line driving circuits, each of which is arranged so as to correspond to a corresponding one of said small regions, for supplying a picture signal to each set of signal lines in parallel, at least one of said plurality of signal line driving circuits including:

1) a shift register for transferring a start pulse in a predetermined transfer direction in accordance with a predetermined timing;

2) a sampling circuit for sampling an input picture signal to supply the picture signal to a corresponding one of said signal lines on the basis of an output of each stage of said shift register; and 3) a control circuit for inverting the transfer direction of said start pulse every predetermined optional horizontal period within a frame.

2. A flat display unit as set forth in claim 1, wherein the transfer direction of the start pulse in one of adjacent two of said plurality of small regions is the reverse of that in the other small region during the same period.

3. A flat display unit as set forth in claim 1, wherein said predetermined optional horizontal period is one horizontal scanning period in which a selecting voltage is applied to one of said plurality of scanning lines.

4. A flat display unit as set forth in claim 1, wherein said sampling circuit is integrally formed on a substrate constituting said flat display unit.

5. A flat display unit comprising:

a display area including a plurality of scanning lines, a plurality of signal lines, a plurality of switching elements, each of which is arranged in the vicinity of each of the intersections of said scanning lines and said signal lines, and a plurality of display pixels, each of which is connected to a corresponding one of said switching elements;

a shift register for transferring a start pulse in a predetermined transfer direction in accordance with a predetermined timing;

a sampling circuit for simultaneously sampling a plurality of input picture signals to simultaneously supply the picture signals to a corresponding some of said plurality of signal lines on the basis of an output of each stage of said shift register; and a control circuit for inverting the transfer direction of said start pulse every predetermined optional horizontal period in a frame.

6. A flat display unit as set forth in claim 5, wherein the polarities of the picture signals supplied to adjacent signal lines of said plurality of signal lines are inverted from each other.

7. A flat display unit as set forth in claim 5, wherein said predetermined optional horizontal period is one horizontal scanning period in which a selecting voltage is applied to one of said plurality of scanning lines.

8. A flat display unit as set forth in claim 5, wherein said sampling circuit is integrally formed on a substrate constituting said flat display unit.

9. A flat display unit comprising:

a display area including a plurality of scanning lines, a plurality of signal lines, a plurality of switching elements, each of which is arranged in the vicinity of each of the intersections of said scanning lines and said signal lines, and a plurality of display pixels, each of which is connected to a corresponding one of said switching elements, said display area being divided into a plurality of small regions, each of which includes a set of signal lines of said plurality of signal lines; and a plurality of signal line driving circuits, each of which arranged so as to correspond to a corresponding one of said small regions, for supplying a picture signal to each set of signal lines in parallel, at least one of said plurality of signal line driving circuits including:

1) a shift register for transferring a start pulse in a predetermined transfer direction in accordance with a predetermined timing;

2) a sampling circuit for simultaneously sampling a plurality of input picture signals to simultaneously supply the picture signals to a corresponding some of said set of signal lines on the basis of an output of each stage of said shift register; and 3) a control circuit for inverting the transfer direction of said start pulse every predetermined optional horizontal period in a frame.

10. A flat display unit as set forth in claim 9, wherein the transfer direction of the start pulse in one of adjacent two of said plurality of small regions is the reverse of that in the other small region during the same period.

11. A flat display unit as set forth in claim 9, wherein the polarities of the picture signals supplied to adjacent signal lines of said plurality of signal lines are inverted from each other.

12. A flat display unit as set forth in claim 9, wherein said predetermined optional predetermined period is one horizontal scanning period in which a sectioning voltage is applied to one of said plurality of scanning lines.

13. A flat display unit as set forth in claim 9, wherein said sampling circuit is integrally formed on a substrate constituting said flat display unit.

* * * * *